US010829841B2

(12) United States Patent
Tonomura et al.

(10) Patent No.: US 10,829,841 B2
(45) Date of Patent: Nov. 10, 2020

(54) HOT WORK TOOL STEEL

(71) Applicant: Nippon Koshuha Steel Co., Ltd., Tokyo (JP)

(72) Inventors: Tsuyoshi Tonomura, Imizu (JP); Kentaro Suzuki, Imizu (JP)

(73) Assignee: NIPPON KOSHUHA STEEL CO., LTD., Tokyo (JP)

( * ) Notice: Subject to any disclaimer, the term of this patent is extended or adjusted under 35 U.S.C. 154(b) by 199 days.

(21) Appl. No.: 15/523,655

(22) PCT Filed: Jan. 6, 2015

(86) PCT No.: PCT/JP2015/050151
§ 371 (c)(1),
(2) Date: May 1, 2017

(87) PCT Pub. No.: WO2016/075951
PCT Pub. Date: May 19, 2016

(65) Prior Publication Data

US 2017/0327933 A1 Nov. 16, 2017

(30) Foreign Application Priority Data

Nov. 11, 2014 (JP) ..... 2014-228936

(51) Int. Cl.

| | |
|---|---|
| ***C22C 38/44*** | (2006.01) |
| ***C22C 38/46*** | (2006.01) |
| ***C21D 6/00*** | (2006.01) |
| ***C22C 38/00*** | (2006.01) |
| ***C22C 38/24*** | (2006.01) |
| ***C22C 38/22*** | (2006.01) |
| ***C22C 38/02*** | (2006.01) |
| ***C22C 38/04*** | (2006.01) |

(52) U.S. Cl.
CPC ..... *C22C 38/44* (2013.01); *C21D 6/00* (2013.01); *C21D 6/002* (2013.01); *C22C 38/00* (2013.01); *C22C 38/001* (2013.01); *C22C 38/02* (2013.01); *C22C 38/04* (2013.01); *C22C 38/22* (2013.01); *C22C 38/24* (2013.01); *C22C 38/46* (2013.01); *C21D 2211/004* (2013.01)

(58) Field of Classification Search
None
See application file for complete search history.

(56) References Cited

U.S. PATENT DOCUMENTS

| | | | | |
|---|---|---|---|---|
| 2004/0200552 | A1* | 10/2004 | Fukumoto | C21D 6/002 148/653 |
| 2005/0123434 | A1 | 6/2005 | Sandberg | |
| 2015/0118098 | A1* | 4/2015 | Valls | C21D 9/00 420/102 |

FOREIGN PATENT DOCUMENTS

| | | | | | |
|---|---|---|---|---|---|
| CN | 1540023 | A | | 10/2004 | |
| CN | 102560264 | A | * | 7/2012 | |
| CN | 102747293 | A | | 10/2012 | |
| DE | 4321433 | C1 | * | 12/1994 | C22C 38/24 |
| JP | 62149852 | A | * | 7/1987 | |
| JP | H 06-093379 | A | | 4/1994 | |
| JP | 2003-226939 | A | | 8/2003 | |
| JP | 2004-339532 | A | | 12/2004 | |
| JP | 2006-504868 | A | | 2/2006 | |
| JP | 2008-126310 | A | | 6/2008 | |
| JP | 2013-087322 | A | | 5/2013 | |
| JP | 5402529 | B2 | | 1/2014 | |
| JP | 5515442 | B2 | | 6/2014 | |
| KR | 20140110720 | A | * | 9/2014 | |

OTHER PUBLICATIONS

Heikkilä, 2013. The Positive Effect of Nitrogen Alloying of Tool Steels Used in Sheet Metal Forming. Acta Universitatis Upsaliensis. Digital Comprehensive Summaries of Uppsala Dissertations from the Faculty of Science and Technology 1045. 56 pp. Uppsala. ISBN 978-91-554-8673-0. (Year: 2013).*
JP-2003226939-A English Translation (Year: 2003).*
KR 2014117020 A English Translation (Year: 2014).*
El-Rakayby, A.M., Mills, B. On the microstructure and mechanical properties of high-speed steels. J Mater Sci 23, 4340-4344 (1988)). (Year: 1988).*
JP 62149852 A Machine English Translation (Year: 1987).*
KR 20140110720 A, Machine English Translation (Year: 2014).*
English machine translation of DE-4321433-C1 (Year: 1994).*
English machine translation of CN-102560264-A (Year: 2012).*
Chinese Office Action dated Apr. 2, 2018 in Chinese Application No. 201580061400.6 with an English translation thereof.
Korean Office Action, dated Jun. 19, 2018, in Korean Application No. 10-2017-7012255 and English of Japanese Translations of Korean Office Action thereof.
International Search Report (ISR) (PCT Form PCT/ISA/210), in PCT/JP2015/050151, dated Mar. 10, 2015.

* cited by examiner

*Primary Examiner* — Alexandra M Moore
*Assistant Examiner* — Catherine P Smith
(74) *Attorney, Agent, or Firm* — McGinn I.P. Law Group, PLLC.

(57) ABSTRACT

This hot work tool steel has a composition containing C: 0.45 to 0.57 mass %, Si: 0.05 to 0.30 mass %, Mn: 0.45 to 1.00 mass %, Cr: 4.5 to 5.2 mass %, Ni: 0.5 mass % or less, Mo+(½) W: 1.0 to 2.0 mass %, V: 0.30 to 0.80 mass %, and N: 0.008 to 0.025 mass %, the remainder being Fe and unavoidable impurities, and the area ratio of carbide having an equivalent circle diameter of 1 μm or less being 20% or higher. It is thereby possible to improve thermal conductivity to thereby shorten cycle time, and improving hardness after heat treatment to improve abrasion resistance while sufficient hardenability is maintained. Consequently, it is possible to obtain a hot work tool steel having excellent toughness with high hardness, excellent corrosion resistance, and minimal degradation of machinability.

13 Claims, No Drawings

HOT WORK TOOL STEEL

TECHNICAL FIELD

The present invention relates to hot work tool steel useful as a material of a mold used in warm-hot pressing, die casting, warm-hot forging, and the like.

BACKGROUND ART

JIS SKD61, which has excellent machinability, is widely used as mold material used in die casting, hot forging, and warm-hot forging. However, JIS SKD61 has low thermal conductivity, and therefore is prone to frequent seizing and heat checking, and a short mold service life.

In view of the above, there has been proposed in the prior art a hot work tool steel in which the Si content is increased and the thermal conductivity is increased without degrading machinability, but by adjusting the individual Mn, Cr, Mo, and V content the impact value is brought higher than multipurpose mold steel while thermal conductivity is kept higher than multipurpose mold steel (patent document 1). The hot work tool steel disclosed in claim 1 of patent document 1 contains C: 0.20 to 0.42 mass %, Si: 0.40 to 0.75 mass %, Mn: 0.65 to 1.50 mass %, Cr: 5.24 to 9.00 mass %, Mo: 1.08 to 2.50 mass %, and V: 0.30 to 0.70 mass %, the remainder being Fe and unavoidable impurities. Claim 4 of patent document 1 indicates that N: 0.004 to 0.024 mass % is included, and claim 2 indicates that W: 0.30 to 4.00 mass % is included.

There is a growing need for lower product costs for injection molded articles composed of plastic and rubber, die cast articles, low-pressure casting articles, and forged articles. Accordingly, there is a demand for improved production efficiency and reduced defect rate for these products.

In view of the above, there has been proposed in the prior art a mold steel with prescribed addition amounts of Si, Mn, and Cr (patent document 2) with an object of increasing the thermal conductivity of a mold to allow rapid cooling of the mold, and thereby allow a shorter cycle time of product production to ensure improved production efficiency, and furthermore ensure a reduction in the defect rate. The composition of the hot work tool steel disclosed in claim 1 of patent document 2 is C: 0.35 to 0.50 mass %, Si: 0.01 to 0.19 mass %, Mn: 1.50 to 1.78 mass %, Cr: 2.00 to 3.05 mass %, Mo: 0.51 to 1.25 mass %, V: 0.30 to 0.80 mass %, and N: 0.004 to 0.040 mass %, the remainder being Fe and unavoidable impurities. Claim 2 of patent document 2 indicates that W: 0.30 to 4.00 mass % is included.

PRIOR ART DOCUMENTS

Patent Documents

Patent Document 1: Japanese Patent No. 5515442
Patent Document 2: Japanese Patent No. 5402529

DISCLOSURE OF THE INVENTION

Problems the Invention Is Intended to Solve

However, the hot work tool steel disclosed in patent document 1 has a problem in that the thermal conductivity is about 26 to 28 (W/m·K), which is low, and the production cycle cannot be shortened. Also, this hot work tool steel has insufficient hardness and is therefore thought to have inferior abrasion resistance.

Meanwhile, the hot work tool steel disclosed in document 2 is not commercially viable because the Cr content is low and therefore hardenability is poor, bainite is generated in a large mold, and toughness is degraded. Another problem with this hot work tool steel is that a water-cooling hole is opened in a die cast or other mold for cooling the mold, and the mold is cooled by cooling water, but since the Cr content is low, rusting and cracking readily occur. Furthermore, the hot work tool steel disclosed in document 2 has insufficient hardness and therefore has inferior abrasion resistance, and since the Si content is low, machinability is inferior.

It is an object of the present invention to provide a hot work tool steel in which thermal conductivity can be improved while sufficient hardenability is maintained, whereby the cycle time can be shortened, hardness after heat treatment can be improved, and abrasion resistance can be improved. In addition, the toughness is exceptional even with high hardness, corrosion resistance is excellent, and the degradation of machinability is minimal.

Means of Solving the Problems

The hot work tool steel according to the present invention contains:

C: 0.45 to 0.57 mass %,
Si: 0.05 to 0.30 mass %,
Mn: 0.45 to 1.00 mass %,
Cr: 4.5 to 5.2 mass %,
Ni: 0.5 mass % or less,
Mo+(½) W: 1.0 to 2.0 mass %,
V: 0.30 to 0.80 mass %, and
N: 0.008 to 0.025 mass %, the remainder being Fe and unavoidable impurities, and
the area ratio of carbide having an equivalent circle diameter of 1 μm or less being 20% or higher.

EFFECTS OF THE INVENTION

According to the present invention, it is possible to obtain a hot work tool steel that has high thermal conductivity, allows a shortened cycle time to improve production efficiency, allows heat stress that accompanies heating and cooling to be reduced, and therefore inhibits heat checking. Also, according to the present invention, it is possible to provide a hot work tool steel that has excellent hardenability, allows any reduction in toughness to be minimized, allows a large mold to be produced, and has excellent abrasion resistance, thus enabling extended service life of a mold.

EMBODIMENT FOR CARRYING OUT THE INVENTION

The present invention is described in detail below. Described first are the reasons for adding the components of the hot work tool steel of the present invention and the reasons for compositional limits.

"C: 0.45 to 0.57 mass %"

C is an element which forms a solid solution in a hot work tool steel matrix and increases the hardness of hot work tool steel. C is also an important element for forming carbides. When C is less than 0.45 mass %, the hardness of steel is reduced and the requisite abrasion resistance cannot be ensured. Also, when C is in excess of 0.57 mass %, the toughness of steel is reduced. Consequently, the C content is set to 0.45 to 0.57 mass %.

"Si: 0.05 to 0.30 mass %"

Si is an important element for increasing the thermal conductivity of steel. When Si is less than 0.05 mass %, the machinability of steel is dramatically reduced, and when Si is included in excess of 0.3 mass %, the thermal conductivity of steel is dramatically reduced. Therefore, the Si content is set to 0.05 to 0.30 mass %.

"Mn: 0.45 to 1.00 mass %"

Mn is an important element for increasing thermal conductivity. When Mn is less than 0.45 wt %, hardenability is dramatically reduced, and when Mn is included in excess of 1.00 wt %, thermal conductivity is dramatically reduced. Therefore, the Mn content is set to 0.45 to 1.00 wt %.

"Cr: 4.5 to 5.2 mass %"

Cr is also an important additive element that increases the thermal conductivity of steel. When Cr is less than 4.5 mass %, the hardenability of steel is dramatically reduced, and when Cr is included in excess of 5.2 mass %, thermal conductivity is dramatically reduced. Therefore, the Cr content is set to 4.5 to 5.2 mass %.

"Ni: 0.5 mass % or less"

Ni is an effective element for improving the hardenability of steel in similar fashion to Cr. When Ni exceeds 0.5 mass %, production costs are disadvantageously increased, and the machinability of steel is reduced. Consequently, the Ni content is set to 0.5 mass % or less.

"Mo+(½) W: 1.0 to 2.0 mass %"

Mo and W are both effective elements for improving hardenability in similar fashion to Cr. When the total of the Mo content and ½ the amount of the W content (Mo+(½) W) is less than 1.0 mass %, the effect of improving hardenability cannot be obtained. On the other hand, when (Mo+(½) W) exceeds 2.0 mass %, the thermal conductivity of steel is reduced and production costs are increased. Accordingly, (Mo+(½) W) is set to 1.0 to 2.0 mass %. However, W has about twice the atomic weight of Mo, and when the atomicity is the same the hardenability and thermal conductivity are the same. Since the two are mutually substitutable in terms of effect, the content range of Mo and W is determined using (Mo+(½) W) as an index. Mo and W may be added alone.

"V: 0.30 to 0.80 mass %"

V is an element that forms carbides and that is effective for improving abrasion resistance and preventing growing of crystal grains during hardening. In order to obtain this effect, the V content must be 0.30 mass % or higher. However, when the V content exceeds 0.80 mass %, coarse carbides are formed in the steel, steel toughness is reduced, and excessive addition of V increases production costs. Accordingly, the V content is set to 0.30 to 0.80 mass %.

"N: 0.008 to 0.025 mass %"

N is an element that forms fine carbides, prevents growing of crystal grains during hardening of the steel, and improves machinability. In order to obtain this effect, the N content must be 0.008 mass % or higher. When the N content exceeds 0.025 mass %, coarse carbides are formed and the toughness of the steel is degraded. Therefore, the N content is set to 0.025% or less.

Thus, in order to achieve the object of the present invention, the respective component compositions must be kept within predetermined compositional ranges, and in particular, it is critical that the C, Si, Mn, and Cr amounts be in the above-stated ranges.

"Area ratio of fine carbides having an equivalent circle diameter of 1 μm or less: 20% or higher"

Ordinarily, when the Si content is reduced, the thermal conductivity of the steel is improved, but a drawback is presented in that the machinability of the steel is degraded. In the present invention, the Si content is reduced, but the reduction in machinability that accompanies this reduction in Si content is offset by making the area ratio of fine carbides having an equivalent circle diameter of 1 μm or less to be 20% or higher, which yields hot work tool steel having about the same machinability as when the Si content is high. When the Si content is reduced, the cutting temperature increases, chip adherence to the tool becomes pronounced, and the tool is also damaged when the adhering material peels away during cutting work. Machinability is thereby degraded. In the present invention, by including a large amount (20% or higher in terms of the area ratio) of fine carbides having an equivalent circle diameter of 1 μm or less, it becomes possible to reduce chip adherence to the tool even if the Si content is reduced, and owing to the fine carbides, the steel matrix becomes brittle, whereby machinability that is equivalent to conventional hot work tool steel can be obtained.

Described next is a method for producing the hot work tool steel of the present invention. Steel materials of the above-described compositions are melted and cast. The resulting ingots are heated and forged for four hours or longer at 1200 to 1280° C., and then machined to predetermined dimensions. Thereafter, the forged material is heated to a temperature of 820 to 870° C. and held for four hours or longer, and then cooled to 400 to 500° C. at a cooling rate of 15 to 35° C. per hour to thereby anneal the steel material. Hot work tool steel containing predetermined amounts of the fine carbides can thereby be produced.

EXAMPLES

Described next are the effects of the present invention using a comparison of the characteristics of hot work tool steel in examples that satisfy the first aspect of the present invention and the characteristics of hot work tool steel in comparative examples that do not fall within the range of the present invention. The steel materials of the examples and comparative examples having the compositions shown in table 1 below were melted in a high-frequency induction furnace, and 20-kg ingots were obtained. The ingots were heated for four hours or longer at a temperature of 1200 to 1280° C. and then forged. The forged material was thereafter heated to a temperature of 820 to 870° C. and held for four hours or longer, and then cooled to 400 to 500° C. at a cooling rate of 15 to 35° C. per hour to thereby anneal the steel material. A heat-treatment hardness test piece, a thermal conductivity test piece, an abrasion test piece, and a Charpy impact test piece were collected from the steel material.

TABLE 1

| | | Composition (mass %) | | | | | | | | |
|---|---|---|---|---|---|---|---|---|---|---|
| | | C | Si | Mn | Cr | Ni | Mo | W | V | N |
| Example | 1 | 0.5 | 0.15 | 0.48 | 4.83 | 0.15 | 1.41 | 0.04 | 0.43 | 0.0143 |
| | 2 | 0.46 | 0.14 | 0.45 | 4.51 | 0.49 | 1.65 | 0.03 | 0.43 | 0.0095 |
| | 3 | 0.57 | 0.15 | 0.45 | 5.20 | 0.30 | 1.72 | 0.02 | 0.48 | 0.0231 |

TABLE 1-continued

| | | Composition (mass %) | | | | | | | | |
|---|---|---|---|---|---|---|---|---|---|---|
| | | C | Si | Mn | Cr | Ni | Mo | W | V | N |
| | 4 | 0.5 | 0.21 | 0.61 | 4.90 | 0.10 | 1.67 | 0.03 | 0.51 | 0.0135 |
| | 5 | 0.51 | 0.15 | 0.62 | 4.80 | 0.18 | 1.98 | 0.04 | 0.30 | 0.0155 |
| | 6 | 0.49 | 0.08 | 0.65 | 4.80 | 0.15 | 1.43 | 0.03 | 0.62 | 0.0129 |
| | 7 | 0.48 | 0.10 | 0.67 | 4.75 | 0.15 | 0.55 | 2.03 | 0.58 | 0.0148 |
| | 8 | 0.49 | 0.29 | 0.65 | 4.90 | 0.05 | 1.78 | 0.04 | 0.35 | 0.0141 |
| | 9 | 0.53 | 0.25 | 0.99 | 5.00 | 0.05 | 0.02 | 2.06 | 0.45 | 0.0195 |
| | 10 | 0.55 | 0.15 | 0.63 | 4.80 | 0.40 | 1.53 | 0.02 | 0.79 | 0.0153 |
| | 11 | 0.47 | 0.18 | 0.64 | 4.60 | 0.45 | 1.39 | 0.01 | 0.47 | 0.0189 |
| | 12 | 0.45 | 0.14 | 0.68 | 4.80 | 0.15 | 1.45 | 0.01 | 0.49 | 0.0082 |
| | 13 | 0.48 | 0.13 | 0.52 | 4.51 | 0.15 | 1.49 | 0.03 | 0.48 | 0.0089 |
| | 14 | 0.49 | 0.05 | 0.49 | 4.53 | 0.15 | 1.48 | 0.02 | 0.52 | 0.0145 |
| Comparative example | 15 | 0.42 | 0.15 | 0.48 | 4.81 | 0.15 | 1.45 | 0.01 | 0.42 | 0.0138 |
| | 16 | 0.59 | 0.16 | 0.47 | 4.83 | 0.15 | 1.48 | 0.02 | 0.43 | 0.0143 |
| | 17 | 0.47 | 0.03 | 0.51 | 4.81 | 0.16 | 1.55 | 0.01 | 0.41 | 0.0128 |
| | 18 | 0.52 | 0.35 | 0.53 | 4.79 | 0.18 | 1.49 | 0.02 | 0.51 | 0.0154 |
| | 19 | 0.49 | 0.15 | 0.38 | 4.85 | 0.14 | 1.51 | 0.04 | 0.48 | 0.0181 |
| | 20 | 0.55 | 0.14 | 1.05 | 4.78 | 0.12 | 1.58 | 0.01 | 0.45 | 0.0105 |
| | 21 | 0.50 | 0.18 | 0.49 | 4.30 | 0.17 | 1.28 | 0.03 | 0.43 | 0.0008 |
| | 22 | 0.51 | 0.16 | 0.50 | 5.40 | 0.18 | 1.37 | 0.03 | 0.43 | 0.0075 |
| | 23 | 0.51 | 0.15 | 0.60 | 4.82 | 0.16 | 0.98 | 0.02 | 0.28 | 0.0285 |
| | 24 | 0.53 | 0.17 | 0.55 | 4.69 | 0.17 | 2.12 | 0.03 | 0.85 | 0.0125 |
| | 25 | 0.51 | 0.14 | 0.49 | 4.81 | 0.12 | 1.85 | 0.02 | 0.71 | 0.0295 |
| | 26 | 0.45 | 0.14 | 0.51 | 4.82 | 0.14 | 1.45 | 0.02 | 0.47 | 0.0082 |
| Prior Art example | 27 | 0.40 | 1.00 | 0.45 | 5.20 | — | 1.20 | 0.03 | 0.75 | 0.0051 |
| | 28 | 0.41 | 0.55 | 1.04 | 5.55 | — | 1.81 | — | 0.51 | 0.0062 |
| | 29 | 0.36 | 0.08 | 1.76 | 3.04 | — | 0.52 | — | 0.78 | 0.0380 |

The heat-treatment hardness was tested by hardening test pieces measuring 25×25 mm at 1030° C., and then tempering the test piece every 5° C. from 500° C. to 620° C. The highest hardness of the test pieces is shown in the column "hardness" in table 2 below. "Thermal conductivity" was tested by heat treating test pieces having a diameter of 10 mm and a thickness of 3 mm, bringing the test pieces to their highest hardness, and then measuring the thermal conductivity value (W/m·K) at room temperature by a laser flash method. "Abrasion resistance" was tested using an Ogoshi-type abrasion test. The test pieces were heat treated at 1030° C., then tempered and finished. The test was carried out at room temperature using 590-MPa high-tensile steel as the counterpart material, an abrasion rate of 2.37 (m/s), a final load of 6.3 kgf, and an abrasion distance of 100 m to evaluate the comparative abrasion quantity ($10^4$ $mm^3$/kgfm). A "hardenability" test was carried out by creating a CCT curve using a Foremaster test, and determining the critical cooling time (minutes) in which bainite is generated. A "toughness" test was carried out by cutting out 10×10×55-mm JIS 3 test pieces, heat treating the test pieces at 1030° C. to bring the hardness to 50 HRC, and thereafter measuring the impact value. The impact value was evaluated using JIS SKD61 steel as a reference, ○ indicating good or equivalent to SKD61, Δ indicating slightly inferior, and x indicating inferior. "Corrosion resistance" was tested by cutting out test pieces having a diameter of 18 mm and a thickness of 15 mm, heat treating the test pieces at 1030° C., bringing the test pieces to 50 HRC, and thereafter performing a test in accordance with JIS 2371, "Methods of salt spray testing." Corrosion resistance was tested using JIS SKD61 steel as a reference, ○ indicating good or equivalent to SKD61 rusting, Δ indicating slightly inferior, and x indicating inferior. "Machinability" was tested by drilling a hole with a depth of 42 mm using a high-speed drill having a diameter of 6 mm, and establishing the service life to be when breakage or high-pitched noises are produced. Using 100 as the service life of JIS SKD61 steel, the machinability of the examples and comparative examples was evaluated in terms of a ratio. The "carbide area ratio" was measured in terms of percentage by polishing test pieces having a dimension of 15 mm×20 mm×10 mm, then corroding the test pieces using picric acid, photographing the test pieces at a magnification of 5000, and then analyzing the image.

TABLE 2

| | | Hardness (HRC) | Therm. conduc. | Abras. resis. | Harden-ability | Tough-ness | Corro. resis. | Machin-ability | Carbide area ratio |
|---|---|---|---|---|---|---|---|---|---|
| Example | 1 | 56.2 | 34.0 | 4.36 | 77 | ○ | ○ | 105 | 25 |
| | 2 | 55.2 | 35.5 | 4.56 | 78 | ○ | ○ | 91 | 23 |
| | 3 | 57.0 | 32.5 | 3.95 | 125 | ○ | ○ | 87 | 28 |
| | 4 | 56.0 | 33.5 | 4.71 | 81 | ○ | ○ | 112 | 24 |
| | 5 | 56.0 | 34.1 | 4.29 | 85 | ○ | ○ | 98 | 24 |
| | 6 | 55.8 | 35.3 | 4.02 | 86 | ○ | ○ | 83 | 24 |
| | 7 | 55.7 | 34.1 | 4.62 | 89 | ○ | ○ | 101 | 23 |
| | 8 | 55.9 | 32.9 | 5.85 | 82 | ○ | ○ | 118 | 25 |
| | 9 | 56.0 | 33.1 | 5.12 | 132 | ○ | ○ | 117 | 27 |
| | 10 | 57.0 | 33.9 | 4.97 | 121 | ○ | ○ | 101 | 23 |
| | 11 | 55.3 | 34.5 | 4.38 | 123 | ○ | ○ | 108 | 20 |
| | 12 | 55.0 | 34.6 | 4.42 | 77 | ○ | ○ | 99 | 23 |

TABLE 2-continued

| | | Hardness (HRC) | Therm. conduc. | Abras. resis. | Harden-ability | Tough-ness | Corro. resis. | Machin-ability | Carbide area ratio |
|---|---|---|---|---|---|---|---|---|---|
| | 13 | 55.6 | 34.8 | 4.31 | 75 | ○ | ○ | 96 | 22 |
| | 14 | 55.9 | 36.0 | 3.98 | 70 | ○ | ○ | 81 | 25 |
| Comparative | 15 | 51.2 | 33.8 | 10.50 | 74 | ○ | ○ | 103 | 18 |
| example | 16 | 58.7 | 34.5 | 3.84 | 76 | x | ○ | 68 | 29 |
| | 17 | 56.1 | 36.8 | 3.82 | 75 | ○ | ○ | 18 | 20 |
| | 18 | 56.7 | 30.2 | 6.32 | 72 | ○ | ○ | 105 | 26 |
| | 19 | 56.3 | 34.9 | 4.25 | 49 | ○ | ○ | 108 | 23 |
| | 20 | 56.9 | 30.8 | 4.15 | 138 | ○ | ○ | 107 | 28 |
| | 21 | 56.3 | 36.2 | 4.35 | 31 | ○ | Δ | 101 | 27 |
| | 22 | 56.4 | 31.5 | 4.78 | 85 | ○ | ○ | 103 | 22 |
| | 23 | 56.1 | 34.2 | 4.36 | 72 | ○ | ○ | 98 | 26 |
| | 24 | 56.5 | 30.9 | 4.28 | 79 | ○ | ○ | 75 | 28 |
| | 25 | 56.9 | 34.4 | 3.98 | 73 | x | ○ | 97 | 25 |
| | 26 | 55.1 | 34.5 | 4.35 | 73 | ○ | ○ | 96 | 16 |
| Prior Art | 27 | 51.3 | 24.0 | 17.35 | 60 | ○ | ○ | 100 | 15 |
| example | 28 | 52.2 | 27.3 | 17.56 | 145 | ○ | ○ | 97 | 16 |
| | 29 | 51.5 | 33.5 | 15.21 | 36 | Δ | x | 15 | 12 |

As shown in tables 1 and 2, comparative examples 15 to 26 do not have component compositions and/or carbide area ratios in the range of the present invention, and are therefore inferior in terms of thermal conductivity, abrasion resistance, hardenability, toughness, corrosions resistance, and machinability. In contrast, examples 1 to 14 of the present invention have component compositions and carbide area ratios that satisfy the range of the present invention, and therefore have desired characteristics in all categories, namely, thermal conductivity, abrasion resistance, hardenability, toughness, corrosions resistance, and machinability.

The invention claimed is:

1. A hot work tool steel, consisting of:

C: 0.45 mass % to 0.57 mass %;

Si: 0.05 mass % to 0.29 mass %;

Mn: 0.45 mass % to 1.00 mass %;

Cr: 4.5 mass % to 5.2 mass %;

Ni: 0.5 mass % or less;

(Mo+(½) W): 1.0 mass % to 2.0 mass %;

V: 0.30 mass % to 0.80 mass %; and

N: 0.008 mass % to 0.025 mass %, a remainder being Fe and unavoidable impurities, the hot work tool steel having an area ratio of carbides having an equivalent circle diameter of 1 μm or less among a total of all sizes of carbides being 20% or higher, and the hot work tool steel having a hardness in a range from 55 HRC to 57 HRC and a thermal conductivity in a range from 32.5 W/m.K. to 36.0 W/m.K.

2. The hot work tool steel according to claim 1, wherein a content of C is in a range from 0.51 mass % to 0.57 mass %.

3. The hot work tool steel according to claim 1, wherein a content of Si is in a range from 0.05 mass % to 0.08 mass %.

4. The hot work tool steel according to claim 1, wherein a content of Ni is in a range from 0.45 mass % to 0.49 mass %.

5. The hot work tool steel according to claim 1, wherein a content of Mo is in a range from 0.02 mass % to 0.55 mass %.

6. The hot work tool steel according to claim 1, wherein a content of W is in a range from 0.02 mass % to 2.06 mass %.

7. The hot work tool steel according to claim 1 herein a content of V is in a range from 0.30 mass % to 0.35 mass %.

8. The hot work tool steel according to claim 1, wherein the hot work tool steel is produced by melting and casting steel materials to make ingots which are heated and forged for at least four hours in a temperature range from 1200° C. to 1280° C. to produce a forged material.

9. The hot work tool steel according to claim 8, wherein the forged material is heated in a temperature range from 820° C. to 870° C. for at least four hours.

10. The hot work tool steel according to claim 9, wherein, after the forged material is heated, the forged material is cooled in a temperature range from 400° C. to 500° C. at a cooling rate of 15° C. to 35° C. per hour to anneal the steel materials.

11. The hot work tool steel according to claim 1, wherein the N in the hot work tool steel prevents crystal grain coarsening during hardening of the hot work tool steel.

12. The hot work tool steel according to claim 1, wherein the area ratio of the carbides having the equivalent circle diameter of 1 μm or less among the total of all sizes of carbides is in a range from 20% to 28%.

13. The hot work tool steel according to claim 1, wherein the hot work tool steel has an abrasion resistance in a range from $3.95\times10^4$ $mm^3$/kgfm to $5.85\times10^4$ $mm^3$/kgfm.

* * * * *